US006988291B2

(12) United States Patent
Jürgens et al.

(10) Patent No.: US 6,988,291 B2
(45) Date of Patent: Jan. 24, 2006

(54) CLEANING IMPLEMENT

(75) Inventors: Ralf Jürgens, Hemsbach (DE); Helmut Hofmeister, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 405 days.

(21) Appl. No.: 10/216,300

(22) Filed: Aug. 9, 2002

(65) Prior Publication Data

US 2003/0031228 A1 Feb. 13, 2003

(30) Foreign Application Priority Data

Aug. 11, 2001 (DE) ..... 101 39 641

(51) Int. Cl.
*A47L 13/20* (2006.01)

(52) U.S. Cl. ..... 15/147.1; 15/1; 15/228; 15/264; 116/207

(58) Field of Classification Search ..... 15/1, 15/143.1, 147.1, 228, 264; 116/207; 252/583
See application file for complete search history.

(56) References Cited

U.S. PATENT DOCUMENTS

| | | | | | |
|---|---|---|---|---|---|
| 4,417,364 | A | * | 11/1983 | Hammond | 15/147.1 |
| 4,957,949 | A | * | 9/1990 | Kamada et al. | 523/201 |
| 5,503,583 | A | * | 4/1996 | Hippely et al. | 446/14 |
| 5,720,555 | A | * | 2/1998 | Elele | 374/150 |
| 5,911,226 | A | * | 6/1999 | Vecchiola et al. | 132/211 |
| 2003/0000451 | A1 | * | 1/2003 | Wilcox | 116/207 |

FOREIGN PATENT DOCUMENTS

| | | | |
|---|---|---|---|
| EP | 0 610 072 | * | 8/1994 |
| EP | 1 027 855 | | 8/2000 |
| EP | 1 260 171 | | 11/2002 |
| GB | 2225930 | | 6/1990 |
| GB | 2 236 071 | * | 3/1991 |
| WO | WO 99/19123 | | 4/1999 |

* cited by examiner

*Primary Examiner*—Randall Chin
(74) *Attorney, Agent, or Firm*—Kenyon & Kenyon

(57) ABSTRACT

A cleaning implement for damp cleaning of surfaces using mopping water includes a first plastic element which indicates the temperature of the mopping water by a reversible change in its color upon contact with the mopping water.

12 Claims, 2 Drawing Sheets

CLEANING IMPLEMENT

BACKGROUND OF THE INVENTION

1. Field of the Invention

The invention relates to a cleaning implement for damp mopping surfaces using mopping water.

2. Description of Related Art

When damp-mopping surfaces, one normally uses mopping water having a higher water temperature than the surrounding temperature, since dirt is thereby more easily loosened, and consequently a better cleaning result is achieved. In this context, devices for cleaning floors are increasingly made, these days, in such a way that the user no longer comes into direct contact with the mopping water. This results in the user's having no information on the water temperature of the mopping water, and he does not notice, for example, when its temperature falls below the desired value.

SUMMARY OF THE INVENTION

It is an object of the invention to provide a cleaning implement which imparts to the user information on the temperature of the mopping water, without the user's having to be in direct contact with the mopping water.

These and other objects of the invention are attained by a cleaning implement having a first plastic element which indicates the temperature of the mopping water, at contact with it, by a reversible change in its color. In doing this, the present invention particularly makes use of the effect of so-called thermochromes or thermosensitive dyes. Such dyes are distinguished by the fact that at a certain temperature, their color changes, that is, they turn from one color to another. When a plastic element provided with such a thermochrome or thermosensitive dye is brought into contact with the mopping water via the cleaning implement, the temperature of the mopping water may be indicated without further effort. The user may detect by the color of the first plastic element, at any time, whether the temperature of the mopping water is below or above the desired value. For that reason, in a particularly advantageous embodiment of the present invention, it is provided that the plastic element shall have a thermochrome dye additive.

BRIEF DESCIPTION OF THE DRAWINGS

The present invention will be described in greater detail with reference to the following drawings wherein.

DETAILED DESCRIPTION OF THE INVENTION

According to the invention, it is further provided that the cleaning implement shall be a damp wiping mop having a mop head.

In accordance with a preferred embodiment of the invention, it is provided that the cleaning implement shall be a mop holder. This may be used, for example, for stretching open a wiping cover, called a flat mop.

According to the invention, it may further be provided that the cleaning implement is a holder for a damp wiping cloth.

Finally, the cleaning implement may also be a damp wiping pail.

Advantageously, the plastic element having a thermochrome dye additive is designed as the mop head or the mop holder or the holder for a damp wiping cloth or the damp wiping pail.

Manufacturing costs may be reduced by designing the plastic element as an additive component, which is connected fixedly or detachably to the mop head or the mop holder or the holder for a damp wiping cloth or the damp wiping pail. This embodiment has the advantage that only a relatively small plastic element has to be furnished with the thermochrome dye additive.

A further improvement is achieved by providing at least one additional plastic element which, by a reversible color change, indicates the temperature of the mopping water by contact with the mopping water, the color-turning temperature of the at least one additional plastic element being different from the color-turning temperature of the first plastic element. This embodiment makes it possible to supply the user more exact information on the temperature of the mopping water and, for example, on whether the temperature of the mopping water is above a desired value and might lead to scalding if the user touched it with his hand.

Beyond that, the present invention relates to a use of a thermochrome dye additive during the fabrication of a cleaning implement for damp mopping surfaces with mopping water, particularly during the fabrication of a mop head or a mop holder or a holder for a damp wiping cloth or a damp wiping pail.

Figure 1:
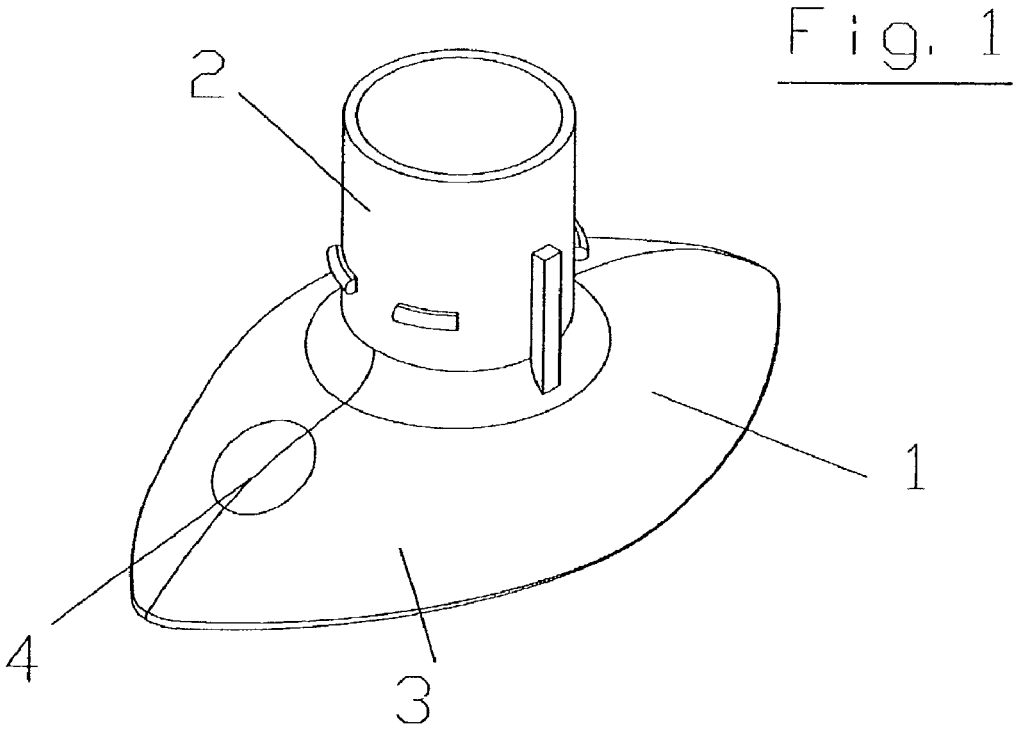
FIG. 1 shows a mop head according to the invention in a perspective view.

FIG. 1 shows a cleaning implement designed as a mop head 1, for damp mopping of surfaces using mopping water. In this case, mop head 1 has a connecting section 2 for connecting it to a handle (not shown). A holding section 3, designed to be shaped essentially oval is also formed at mop head 1, connecting section 2 and holding section 3 being formed in one piece as a plastic injection-molded part.

A water-absorbing cleaning material, such as a nonwoven fabric in the form of fringes, may be affixed in a known way to holding section 3. Mop head 1 also has a first plastic element 4 which indicates, at contact with the mopping water, whether its temperature lies below or above a certain point, namely the color turning point of the plastic element. To do this, the first plastic element has a thermochrome or thermosensitive dye additive. Such material additives may be added to a heated thermoplastic plastic before it is pressed into a mold and set. According to the present invention, it has proven successful to use polyethylene (PE) or polypropylene (PP) as the plastic for plastic element.

Figure 2:
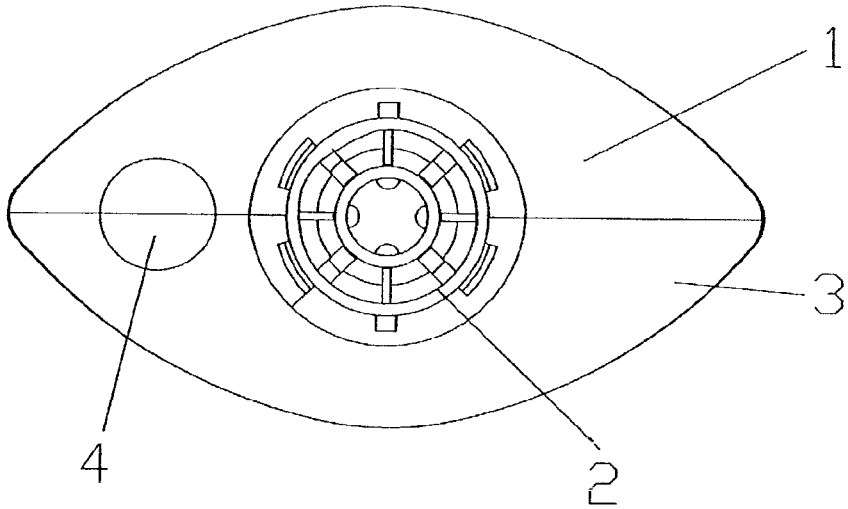
FIG. 2 shows a mop head according to the invention in a top view.

Instead of the embodiment shown in FIGS. 1 and 2, in which a first plastic element 4 is fixed to mop head 1, it would also be possible, to provide the entire mop head 1 made of plastic with a thermochrome dye additive.

Also, instead of illustrated mop head 1, in the same manner, a mop holder not shown, a holder for a damp wiping cloth or a mopping pail having a thermochrome or thermosensitive dye additive could be provided.

Finally, in a manner different from that shown, it would also be possible to situate first plastic element 4 on mop head 1 in detachable fashion.

Then again, instead of a single plastic element 4, one or more additional plastic elements having a thermochrome or thermosensitive dye additive could be applied, the color turning temperature of the at least one further plastic element being different from the color turning temperature of the first plastic element. In this manner, temperature ranges and maximum temperatures may also be indicated.

What is claimed is:

1. A cleaning implement for damp mopping surfaces using mopping water, comprising a first plastic element (4), configured to indicate a temperature of the mopping water by a reversible change in its color upon contacting the mopping water, wherein the cleaning implement is at least one of (i) a mop having a mop head (1) and (ii) a mop holder.

2. The cleaning implement according to claim 1, wherein the plastic element (4) includes a thermochrome dye additive.

3. The cleaning implement according to claim 2, wherein the holder is for a damp wiping cloth.

4. The cleaning implement according to claim 3, wherein the plastic element having a thermochrome dye additive is designed as the holder for a damp wiping cloth.

5. The cleaning implement according to claim 1, wherein the holder is for a damp wiping cloth.

6. The cleaning implement according to claim 5, wherein the plastic element is designed as an additional component which is connected fixedly or detachably to the holder for a damp wiping cloth.

7. The cleaning implement according to claim 1, wherein the plastic element having a thermochrome dye additive is designed as the mop head (1).

8. The cleaning implement according to claim 1, wherein the plastic element having a thermochrome dye additive is designed as the mop holder.

9. The cleaning implement according to claim 1, wherein the plastic element is designed as an additional component which is connected fixedly or detachably to the mop head (1).

10. The cleaning implement according to claim 1, wherein the plastic element is designed as an additional component which is connected fixedly or detachably to the mop holder.

11. A cleaning implement for damp mopping surfaces using mopping water, comprising a first plastic element (4), which indicates the temperature of the mopping water by a reversible change in its color upon contacting the mopping water, and at least one additional plastic element which indicates the temperature of the mopping water by a reversible change in its color upon contact with the mopping water, wherein the color turning temperature of the at least one additional plastic element is different from the color turning temperature of the first plastic element.

12. A cleaning implement for damp mopping surfaces using mopping water, comprising a first plastic element (4), which indicates the temperature of the mopping water by a reversible change in its color upon contacting the mopping water and which includes a thermochrome dye additive, and at least one additional plastic element which indicates the temperature of the mopping water by a reversible change in its color upon contact with the mopping water, wherein the color turning temperature of the at least one additional plastic element is different from the color turning temperature of the first plastic element.

* * * * *